United States Patent [19]

Lo et al.

[11] Patent Number: 4,771,291

[45] Date of Patent: Sep. 13, 1988

[54] DUAL FREQUENCY MICROSTRIP ANTENNA

[75] Inventors: Yuen T. Lo, Urbana, Ill.; Boa F. Wang, Beijing, China

[73] Assignee: The United States of America as represented by the Secretary of the Air Force, Washington, D.C.

[21] Appl. No.: 771,529

[22] Filed: Aug. 30, 1985

[51] Int. Cl.[4] ..... H01Q 00/00

[52] U.S. Cl. ..... 343/700 MS

[58] Field of Search ..... 343/700 MS

[56] References Cited

U.S. PATENT DOCUMENTS

| | | | |
|---|---|---|---|
| Re. 29,296 | 7/1977 | Krutsinger | 343/700 MS |
| 4,040,060 | 8/1977 | Kaloi | 343/700 MS |
| 4,078,237 | 3/1978 | Kaloi | 343/700 MS |
| 4,130,822 | 12/1978 | Conroy | 343/700 MS |
| 4,191,959 | 3/1980 | Kerr | 343/700 MS |
| 4,197,545 | 4/1980 | Favaloro | 343/700 MS |
| 4,242,685 | 12/1980 | Sanford | 343/700 MS |
| 4,367,474 | 1/1983 | Schaubert | 343/700 MS |
| 4,379,296 | 4/1983 | Farrar | 343/700 MS |
| 4,386,357 | 5/1983 | Patten | 343/700 MS |
| 4,489,328 | 12/1984 | Gears | 343/700 MS |

FOREIGN PATENT DOCUMENTS

| | | |
|---|---|---|
| 2092827 | 2/1981 | United Kingdom . |
| 2074792 | 11/1981 | United Kingdom . |

OTHER PUBLICATIONS

Article by Boa F. Wang and Yuen T. Lo entitled "Microstrip Antennas for Dual Frequency Operation" appeared in IEEE Transactions on Antennas and Propagation dtd Sep. 1984.

*Primary Examiner*—William L. Sikes
*Assistant Examiner*—Robert E. Wise
*Attorney, Agent, or Firm*—William G. Auton; Donald J. Singer

[57] ABSTRACT

A single element patch microstrip antenna for dual frequency operation is disclosed. By placing shorting pins at appropriate locations in the patch, the ratio of two band frequencies can be varied from 3 to 1.8. By also introducing slots in the patch, the ratio can be reduced from 3 to less than 1.3. A second embodiment of the antenna uses a c-shaped slot to obtain an even smaller ratio of two band frequencies.

12 Claims, 6 Drawing Sheets

LEGEND

EXPERIMENT

× THEORY

EXPERIMENT (NO SLOT)

INCREMENT 10 MHz ( INCREASING FREQUENCY IS CLOCKWISE )

LEGEND MEASURED XXXX COMPUTED

DUAL FREQUENCY MICROSTRIP ANTENNA

STATEMENT OF GOVERNMENT INTEREST

The invention described herein may be manufactured and used by or for the Government for governmental purposes without the payment of any royalty thereon.

BACKGROUND OF THE INVENTION

The present invention relates generally to microstrip antennas, and more particularly to a single element patch microstrip antenna which is adapted for dual frequency operation.

Microstrip antennas are one of the most active research and development subjects today. These antennas are unique in many ways: extremely compact in structure, light in weight, easy to fabricate and to reproduce precisely (by printed circuit technique), capable to be integrated with other microwave devices and IC circuits, etc. However, they are narrow-banded, unless thick substrate is used. In spite of this restriction, they find more and more applications each day, particularly wherever space and weight are limited.

In many applications, it is not operation in a continuous wide-band, but, operation in two or more discrete bands that is required. In this case, a thin patch capable of operating in multiple bands is highly desirable, particularly for large array application where considerable saving in space, weight, material and cost can be achieved. For that goal, a few attempts have been made by using two or more patch antennas stacked on top of each other, or placed side by side, or using a complex matching network which takes as much space and weight, if not more, as the element itself. Obviously in all those designs, the advantage of compact structure is sacrificed.

The task of producing microstrip antennas capable of two or more bands of operation has been alleviated, to some degree, by the following U.S. Patents, which are incorporated herein by reference:

- U.S. Pat. No. 4,379,296, issued to Farrar et al on Apr. 5, 1983;
- U.S. Pat. No. 4,367,474, issued on Schaubert et al on Jan. 4, 1983;
- U.S. Pat. No. 4,386,357, issued to Patton on May 31, 1983;
- U.S. Pat. No. 4,040,060, issued to Kaloi on Aug. 2, 1977;
- U.S. Pat. No. Re. 29,296, issued to Krutsinger et al on July 5, 1977;
- U.S. Pat. No. 4,191,959, issued to Kerr on Mar. 4, 1980;
- U.S. Pat. No. 4,489,328, issued to Gears on Dec. 18, 1984;
- U.S. Pat. No. 4,130,822, issued to Gonroy on Dec. 19, 1978;
- U.S. Pat. No. 4,197,545, issued to Favaloro et al on Apr. 8, 1980;
- U.S. Pat. No. 4,242,685, issued to Sanford on Dec. 30, 1980;
- U.S. Pat. No. 3,757,344, issued to Pereda on Sept. 4, 1973; and
- U.S. Pat. No. 4,078,237, issued to Kaloi on Mar. 7, 1978.

U.S. Pat. Nos. 4,379,296; 4,367,474; 4,386,357; 4,040,060; and 4,078,237 disclose patch antennas which include shorting pins. U.S. Pat. Nos. Re. 29,246, 4,191,959; 4,489,328; 4,130,822; 4,197,545; 4,242,685; and 3,757,344 disclose patch antennas with slots therein.

From the foregoing discussion, it is apparent that recent work has been directed towards the need to develop a single element microstrip antenna capable of operating at two or more controllable frequencies. The present invention is directed towards satisfying that need.

SUMMARY OF THE INVENTION

The present invention includes a single element patch microstrip antenna for dual frequency operation. By placing shorting pins at appropriate locations in the patch, the ratio of two band frequencies can be varied from 3 to 1.8. By also introducing slots in the patch the ratio can be reduced from 3 to less than 1.3. A second embodiment of the invention would use a c-shaped slot to obtain an even smaller ratio of two band frequencies.

It is a principal object of the present invention to produce a single element microstrip antenna capable of two or more bands of operation.

It is another object of the present invention to introduce both slots and shorting pins into a microstrip antenna to optimize the ratio between the two band frequencies produced during dual frequency operation.

By using these elements, a single large array can operate at two (or more) frequencies, thus replacing two (or more) large arrays of conventional design and resulting in a great saving.

These together with other objects features and advantages of the invention will become more readily apparent from the following detailed description when taken in conjunction with the accompanying drawings, wherein like elements are given like reference numerals throughout.

DESCRIPTION OF THE DRAWINGS

FIG. 6*b* illustrates measured radiation pattern for the rectangular microstrip antenna of FIG. 6*a.

DETAILED DESCRIPTION OF THE PREFERRED EMBODIMENT

The present invention is a single element patch microstrip antenna adapted for dual frequency operation using both slots and shorting pins to control a ratio between two band frequencies.

Figure 1:
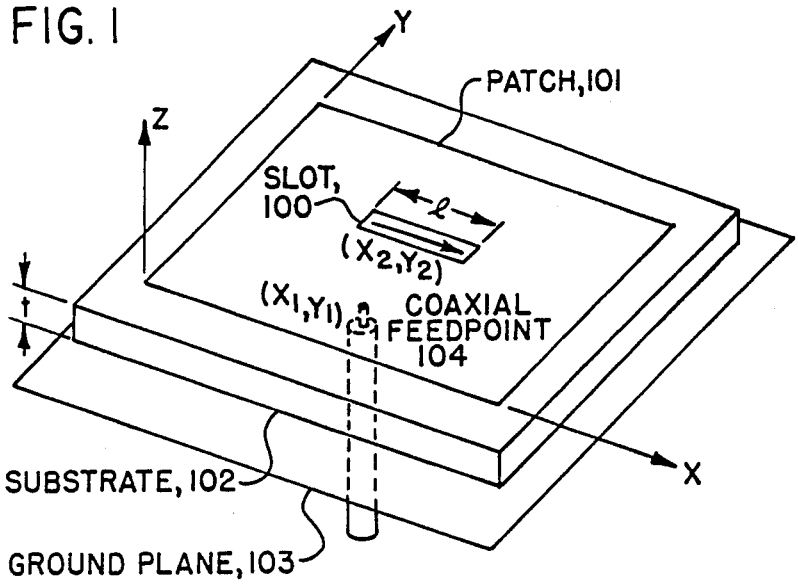
FIG. 1 is a sketch depicting the geometry of a rectangular microstrip antenna with idealized feeds.

The reader's attention is now directed to FIG. 1, which depicts a schematic of a microstrip antenna being excited by a magnetic current K in the slot centered at (X'Y'). The slot 100 is cut in a patch 101 which is surrounded by a substrate 102 which coats a conducting ground plane 103 which is fed by a coaxial feed 104. The substrate 102 is typically composed of a dielectric material, and serves to separate the conductive patch 101 from the conductive layer that forms the ground plane 103. Additionally, although a coaxial cable 104 is depicted as a means of feeding radio frequency signals to the ground plane, other subsistutes such as microstrips, striplines, and waveguides may be used.

The antenna can be considered as a cavity bounded by magnetic walls along its perimeter and electric walls at z=0 and t. Since the substrate thickness t is typically a few hundreths of a wavelength, one can assume that the field excited by the magnetic current $$\underset{\sim}{K}=\hat{x}[U(x-x'+d_{eff}/2)-U(x-x'-d_{eff}/2)]\cdot\delta(y-y')\delta(z-t)$$

in the slot is approximately the same as that excited by $$\underset{\sim}{K}=\hat{x}[U(x-x'+d_{eff}/2)-U(x-x'-d_{eff}/2)]\delta(y-y')\cdot[U(z)-U(z-t)]t$$

where $d_{eff}$ is the effective width of the magnetic current strip of one V/M, and U(.) is the unit step function. The field in the cavity due to $\underset{\sim}{K}$ can then be found by modal-matching as given below:

In region I ($y'\leqq y\leqq b$)

$$E_{z1}=\frac{d_{eff}}{at}\sum_{m=0}^{\infty}\frac{\sin(\beta_m y')\cos(m\pi x'/a)}{\sin(\beta_m b)}j_o\left(\frac{m\pi d_{eff}}{2a}\right)\cos(m\pi x/a)\cos[\beta_m(b-y)],\tag{1}$$

$$H_{x1}=\frac{jd_{eff}}{at\omega\mu_o}\sum_{m=0}^{\infty}\frac{\beta_m\sin(\beta_m y')\cos(m\pi x'/a)}{\sin(\beta_m b)}j_o\left(\frac{m\pi d_{eff}}{2a}\right)\cos(m\pi x/a)\sin[\beta_m(b-y)],$$

$$H_{y1}=\frac{j\pi d_{eff}}{a^2t\omega\mu_o}\sum_{m=0}^{\infty}\frac{m\sin(\beta_m y')\cos(m\pi x'/a)}{\sin(\beta_m b)}j_o\left(\frac{m\pi d_{eff}}{2a}\right)\sin(m\pi x/a)\cos[\beta_m(b-y)].$$

In region II ($0\leqq y\leqq y'$)

$$E_{z2}=\frac{-d_{eff}}{at}\sum_{m=0}^{\infty}\frac{\sin[\beta_m(b-y')]\cos(m\pi x'/a)}{\sin(\beta_m b)}j_o\left(\frac{m\pi d_{eff}}{2a}\right)\cos(m\pi x/a)\cos(\beta_m y),\tag{2}$$

$$H_{x2}=\frac{jd_{eff}}{at\omega\mu_o}\sum_{m=0}^{\infty}\frac{m\sin[\beta_m(b-y')]\cos(m\pi x'/a)}{\sin(\beta_m b)}j_o\left(\frac{m\pi d_{eff}}{2a}\right)\cos(m\pi x/a)\sin(\beta_m y),$$

$$H_{y2}=\frac{-j\pi d_{eff}}{a^2t\omega\mu_o}\sum_{m=0}^{\infty}\frac{m\sin[\beta_m(b-y')]\cos(m\pi x'/a)}{\sin(\beta_m b)}j_o\left(\frac{m\pi d_{eff}}{2a}\right)\sin(m\pi x/a)\cos(\beta_m y),$$

where $\beta_m^2=k^2-(m\pi/a)^2$, $k^2=k_o^2\epsilon_r(1-j\delta_{eff})$, $k_o$=free space wave number, $\epsilon_r$=relative dielectric constant of the substrate, $\delta_{eff}$=effective loss tangent, $\mu_o$=permeability of free space $j_o(x)=\sin(x)/x$, and $d_{eff}$="effective width" of the magnetic current strip of one V/M. Examination of Equations (1) and (2) indicates that the resonance occurs when $Re(\beta_m b)\simeq n\pi$, n=1, 2, . . . , or $Re(k)\simeq[(m\pi/a)^2+(n\pi/b)^2]^{\frac{1}{2}}$ since $\delta_{eff}<<1$. The value $\beta_m$ for the particular value of n is denoted as $\beta_{mn}$, and its associated field is called the mnth mode. Clearly in the neighborhood of this resonance field will be denominated by the term associated with $\beta_{mn}$, the value of which depends on the feed location (x'y'). Following the cavity model theory, once the field distribution is found, the Huygen source, $\underset{\sim}{K}(x,y)=\hat{n}x\hat{z}E(x,y)$ along the perimeter can be determined. From $\underset{\sim}{K}$, the far field can then be computed as given below:

$$E_\theta=jk_o(F_x\sin\phi+F_y\cos\phi),$$

$$E_\phi=-jk_o(F_x\cos\phi+F_y\sin\phi)\cos\theta,\tag{3}$$

where $$F_x=\frac{d_{eff}e^{-jk_or}}{2\pi r}\sum_{m=0}^{\infty}\{A_m\sin(\beta_m y')e^{jk_obs\sin\theta\sin\phi}+\sin[\beta_m(b-y')]\}\cdot\frac{jk_oa\sin\theta\cos\phi}{(m\pi)^2-(k_oa\sin\theta\cos\phi)^2},\tag{4}$$

$$F_y=\frac{bd_{eff}e^{-jk_or}}{2\pi ra}\sum_{m=0}^{\infty}A_m\{[\sin(\beta_m b)e^{jk_oy'\sin\theta\sin\phi}+\sin(\beta_m y')e^{jk_obs\sin\theta\sin\phi}+\sin[\beta_m(b-y')]\}\frac{jk_ob\sin\theta\sin\phi}{(\beta_m b)^2-(k_ob\sin\theta\sin\phi)^2},\tag{5}$$

$$A_m=\frac{\cos(m\pi x'/a)j_o(m\pi d_{eff}/2a)}{\sin(\beta_m b)}[(-1)^m e^{jk_oa\sin\theta\cos\phi}-1].\tag{6}$$

Also, from the field in the cavity, the ohmic and dielectric losses as well as the stored energy can be computed and finally the effective loss tangent can be determined.

The theory for a microstrip antenna with shorting pins is best understood in the context of an analysis of a microstrip with multiple ports.

Consider a rectangular microstrip antenna with two ports: port 1 at $(x_1, y_1)$ is fed with an electric current $J_1$, and port 2 at $(x_2, y_2)$ is fed with a magnetic current $K_2$ as shown in FIG. 1. The following hybrid matrix can then be used to describe the relationship between the voltage and current at these ports:

$$\begin{bmatrix} V_1 \\ I_2 \end{bmatrix} = \begin{bmatrix} h_{11} & h_{12} \\ h_{21} & h_{22} \end{bmatrix} \begin{bmatrix} I_1 \\ V_2 \end{bmatrix} \tag{7}$$

where $I_1 = d_{1eff} J_1$, $d_{1eff}$=effective width of source $J_1$, $V_2 = tK_2$ and the h parameters are given below:

$$h_{11} = -jt\omega\mu_o \sum_{m=0}^{\infty} \frac{\cos^2(m\pi x_1/a)\cos(\beta_m y_1)\cos[\beta_m(b-y_1)]}{a\beta_m \sin(\beta_m b)} j_o^2[m\pi d_{1eff}/2a] \tag{8}$$

$$h_{12} = -\frac{d_{2eff}}{a} \sum_{m=0}^{\infty} \frac{\sin[\beta_m(b-y_2)]\cos(\beta_m y_1)}{\sin(\beta_m b)} \cos(m\pi x_1/a)\cos(m\pi x_2/a) \cdot j_o(m\pi d_{1eff}/2a)\, j_o(m\pi d_{2eff}/2a) \tag{9}$$

$$h_{21} = -h_{12} \tag{10}$$

$$h_{22} = \frac{jd_{2eff}^2}{ta\omega\mu_o} \sum_{m=0}^{\infty} \frac{\beta_m \sin(\beta_m y_2)\sin[\beta_m(b-y_2)]}{\sin(\beta_m b)} \cos^2(m\pi x_2/a) j_o^2\left(\frac{m\pi d_{2eff}}{2a}\right) \tag{11}$$

From Equations (8)–(11) all the z-parameters can thus be determined by the relationship between h and z parameters. Then, the input impedance at port 1, $Z_{in}$, can be computed:

$$Z_{in} = Z_{11} - Z_{12}^2/(Z_{22} + Z_L) \tag{12}$$

where $Z_L$ is the load impedance across the slot terminals at $(x_x, y_2)$. The far field electric vector potential, F, for the two sources can be obtained by superposition as given below:

$$\underline{F} = \underline{F}_1 + \underline{P}\underline{F}_2 \tag{13}$$

where $$\underline{F}_1 = \frac{jk_o\eta t b e^{-jk_o r}}{2\pi r} \sum_{m=0}^{\infty} \frac{\epsilon_{om}\cos(m\pi x_1/a) j_o(m\pi d_{1eff}/2a)}{\beta_m b \sin(\beta_m b)} [(-1)^m e^{jk_o a \sin\theta\cos\phi} - 1] \cdot [\hat{x}[\cos(\beta_m y_1) e^{jk_o b \sin\theta\sin\phi} - \cos[\beta_m(b-y_1)]] \frac{jk_o a \sin\theta\cos\phi}{(m\pi)^2 - (k_o a \sin\theta\cos\phi)^2} - \hat{y}\frac{b}{a}[\beta_m b \sin(\beta_m b) e^{jk_o y_1 \sin\theta\sin\phi} + jk_o b \sin\theta\sin\phi\,[\cos(\beta_m y_1) e^{jk_o b \sin\theta\sin\phi} - \cos[\beta_m(b-y_1)]] \cdot [(\beta_m b)^2 - (k_o b \sin\theta\sin\phi)^2]^{-1}, \tag{14}$$

$$\underline{F} = 2\frac{d_{eff} e^{-jk_o r}}{2\pi r} \sum_{m=0}^{\infty} \frac{\cos(m\pi x_2/a) j_o(m\pi d_{2eff}/2a)}{\sin(\beta_m b)} [(-1)^m e^{jk_o a \sin\theta\cos\phi} - 1] \cdot [\hat{x}[\sin\beta_m y_2) e^{jk_o b \sin\theta\sin\phi} + \sin[\beta_m(b-y_2)]] \frac{jk_o a \sin\theta\cos\phi}{(m\pi)^2 - (k_o a \sin\theta\cos\phi)^2} + y\frac{b}{a}[\sin(\beta_m b) e^{jk_o y_2 \sin\theta\sin\phi} + \sin(\beta_m y_2) \cdot e^{jk_o b \sin\theta\sin\phi} + \sin[\beta_m(b-y_2)]] \frac{jk_o b \sin\theta\sin\phi}{(\beta_m b)^2 - (k_o b \sin\theta\sin\phi)^2}$$

$$P = j\omega\mu_o \frac{\cos(m\pi x_1/a)\, j_o(m\pi d_{1eff}/2a)}{\beta_m a \sin(\beta_m b)} \cos(\beta_m y_1)\cos[\beta_m(b-y_2)]\cos(m\pi x_2/a) \tag{16}$$

From these and equation (3), the far field is readily computed. The analysis can be generalized for N slots in a straightforward manner.

Figure 4:
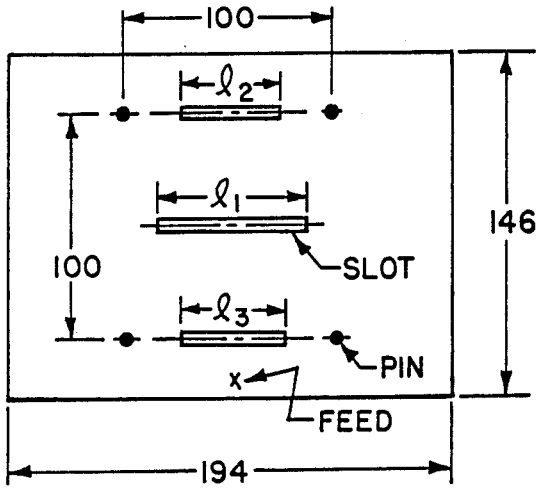
FIG. 4 is a schematic of the microstrip antenna with shorting pins and slots of the present invention.

A similar theory has been developed for a microstrip antenna with shorting pins. For N pins at N ports, the impedance parameters $Z_{ii}$ and $Z_{ij}$ are given by:

$$Z_{ii} = -jk_o t\eta_o \sum_{m=0}^{\infty} \frac{\epsilon_{om}}{a} \cos^2(m\pi x_i/a) j_o^2\left(\frac{m\pi d_{ieff}}{2a}\right) \frac{\cos(\beta_m y_i)\cos[\beta_m(b-y_i)]}{\beta_m \sin(\beta_m b)} \tag{17}$$

$$Z_{ij} = jk_o t\eta_o \sum_{m=0}^{\infty} \frac{\epsilon_{om}}{a} \cos(m\pi x_i/a)\cos(m\pi x_j/a) j_o^2(m\pi d_{ieff}/2a) \cdot \frac{\cos[\beta_m(b-y_j)]\cos(\beta_m y_i)}{\beta_m \sin(\beta_m b)} \tag{18}$$

where $\eta_o$=377 ohms, $\epsilon_{om}$=1 for m=0, and 2 otherwise, $(x_i, y_i)$ and $(x_j, y_j)$ are the coordinates of the source J and shorting pin, respectively. For a general case, when the N ports consist of both slots and pins as shown in FIG. 4, the currents and voltages at the N ports can also be written as follows:

$$\sum_j I_j Z_{ij} = V_i,\ i,j = 1, \ldots, N. \tag{19}$$

since the solutions to $\underset{\sim}{E}$ and $\underset{\sim}{H}$ everywhere in the patch for any $\underset{\sim}{J}$ and $\underset{\sim}{K}$ have been obtained, one can therefore compute the input impedance $Z_{in}$ at any port, using the same method as discussed above.

The dual-frequency microstrip antenna of the present invention is based on the theoretical argument that shorting pins and slots if placed at appropriate locations in the patch can raise the (0,1) and lower the (0,3) operating frequencies, respectively. In general, with pins and slots, the modal field is no longer pure. The existance of a substantial amount of higher order modes will modify the antenna overall resonant frequency which occurs when the reflection coefficient $|\Gamma|$ reaches a minimum, or a maximum.

Several antennas have been constructed and tested to determine the validity of the theory. All of them were made of double copper-clad laminate Rexolite 2200, 1/16" thick. The relative permittivity $\epsilon_r \simeq 2.62$, the loss tangent $\delta - 0.001$, and the copper clading conductivity$\simeq$270 KMho. These values were used for theoretical computations.

Figure 2:
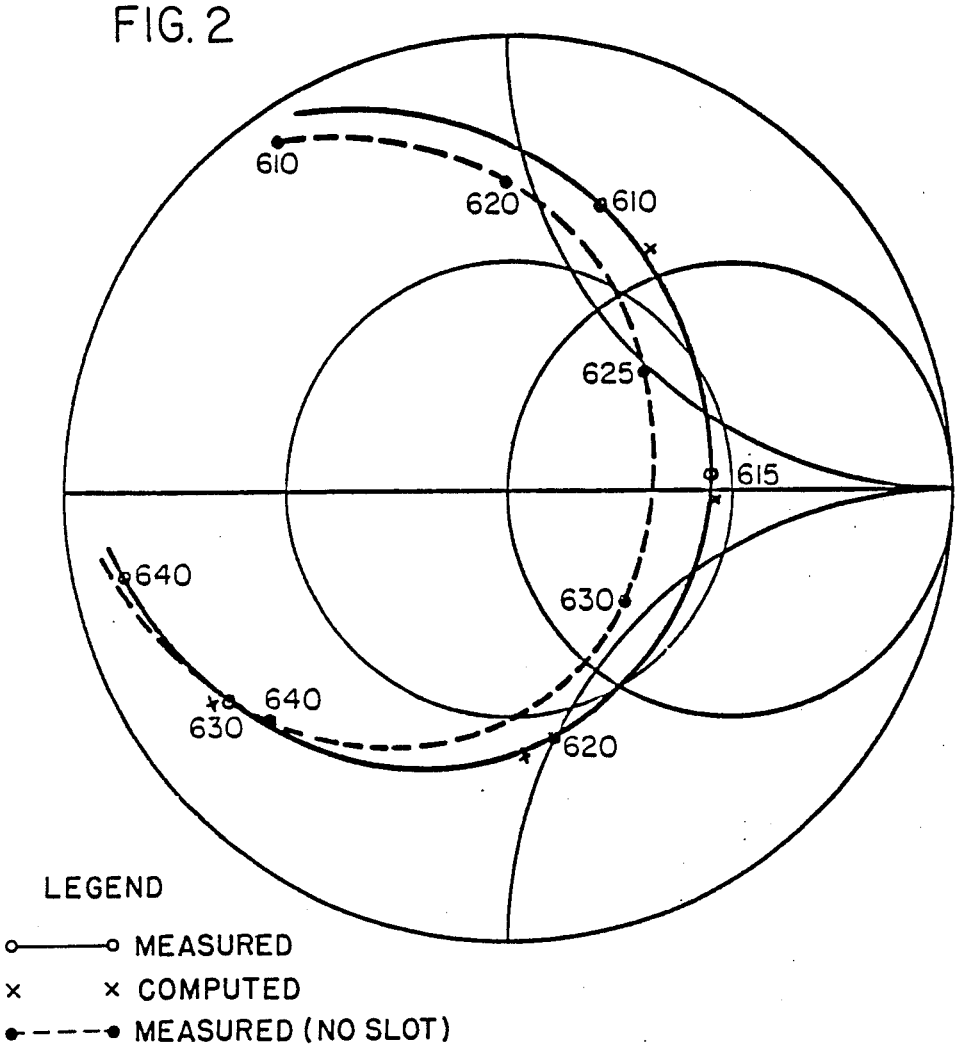
FIG. 2*a* is a sketch depicting measured and computed impedance loci of a rectangular microstrip antenna with one slot for low band.
FIG. 2*b* is a sketch depicting measured and compared impedance loci for high band.
FIG. 2*c* illustrates measured and computed radiation patterns for both bands.
Figure 2B:
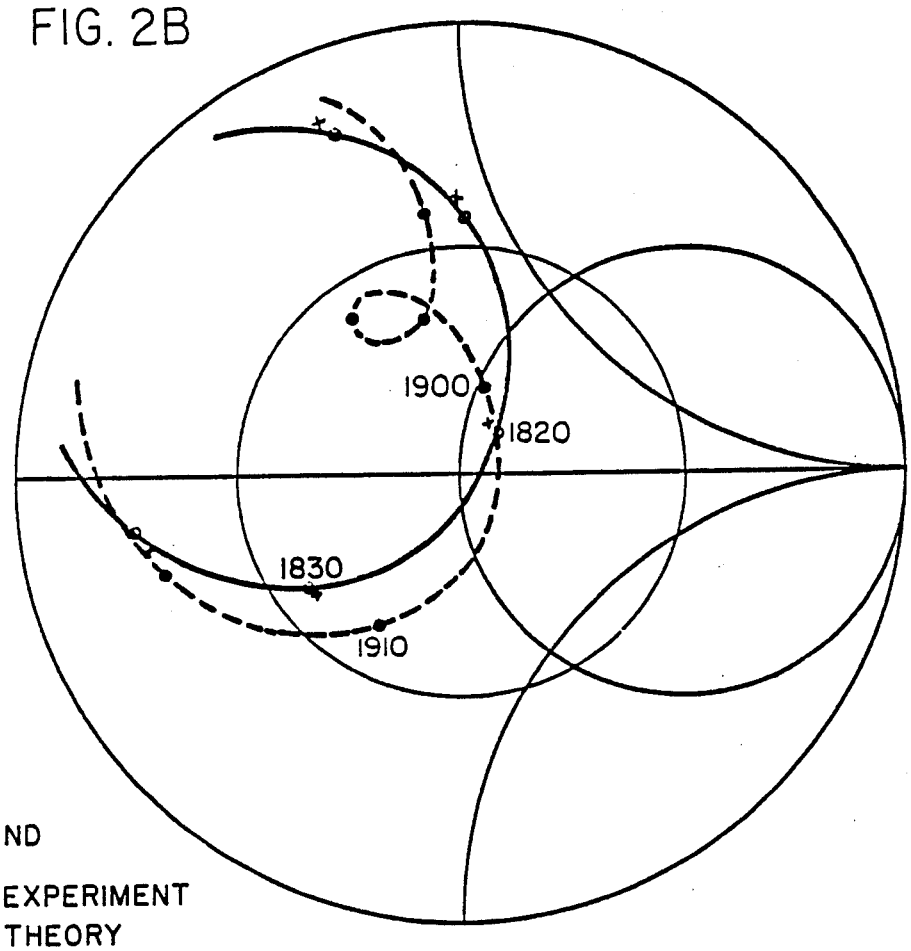
Figure 2C:
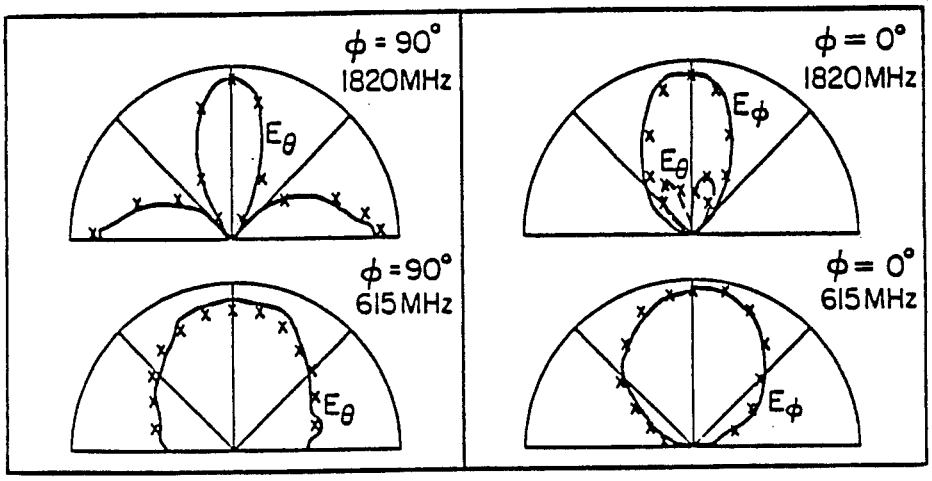
Figure 3A:
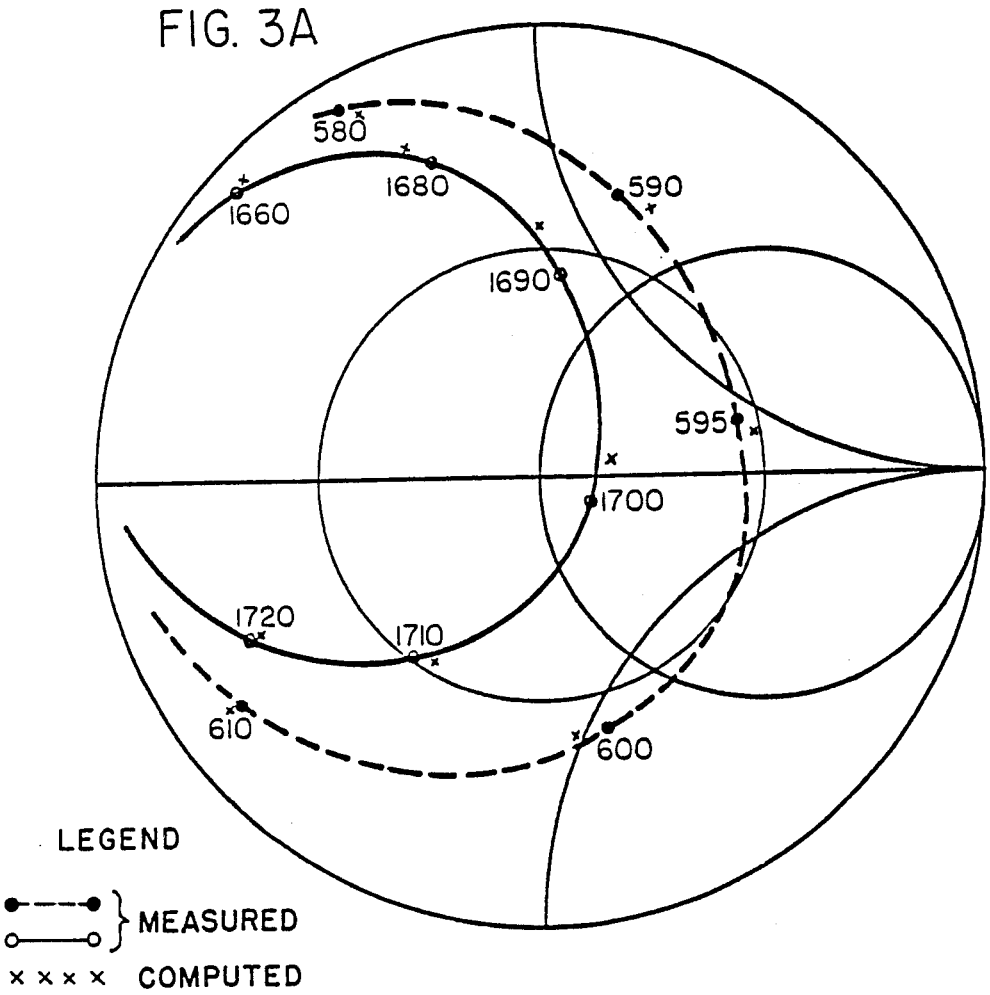
FIG. 3*a* illustrates measured and computed impedance loci for a rectangular microstrip antenna with one slot.
Figure 3B:
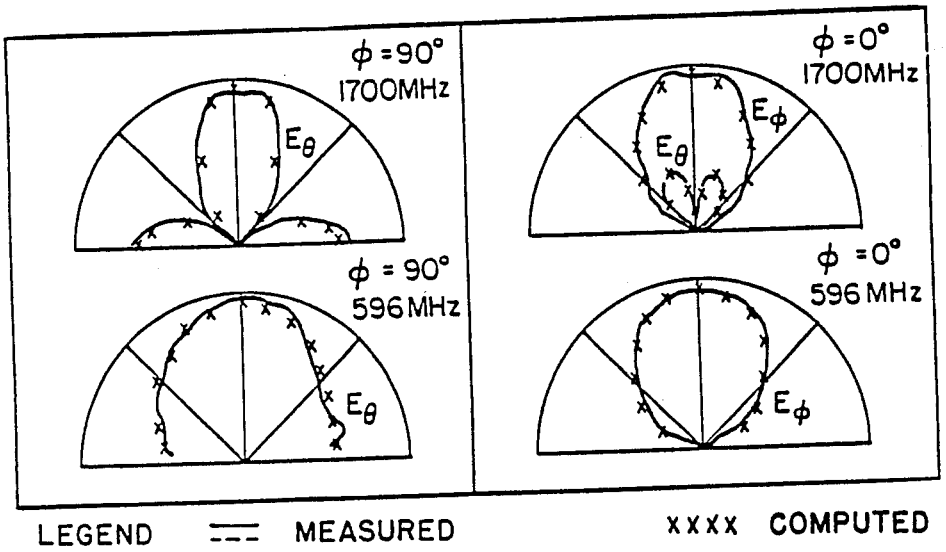
FIG. 3*b* illustrates measured and computed radiation pattern for the rectangular microstrip antenna of FIG. 3*a;*

One of the rectangular microstrip antennas, having the dimensions a=19.4 cm and b=14.6 cm, is fed with a miniature cable at $x_1=9.7$ cm and $y_1=0$ as shown in FIG. 1. A slot of length l=3.0 cm and width w=0.15 cm is cut at $x_2=9.7$ cm and $y_2=7.3$ cm on the patch. The feed location was chosen for a good match to the 50 ohm lines for both $F_H$ and $F_L$ bands. The calculated and measured input impedance loci for both bands are shown in FIGS. 2*a* and 2*b*, where for comparison the corresponding loci without slot are also shown by the dashed curves. The calculated and measured radiation patterns are shown in FIG. 2*c*. Similar results for slot length l=4.5 cm are shown in FIGS. 3*a* and 3*b*. It is seen that the agreement between theoretical and measured results is excellent for both bands and that the slot has only a minor effect on the low band impedance locus, but a significant effect on the high band impedance locus as expected.

Figure 5A:
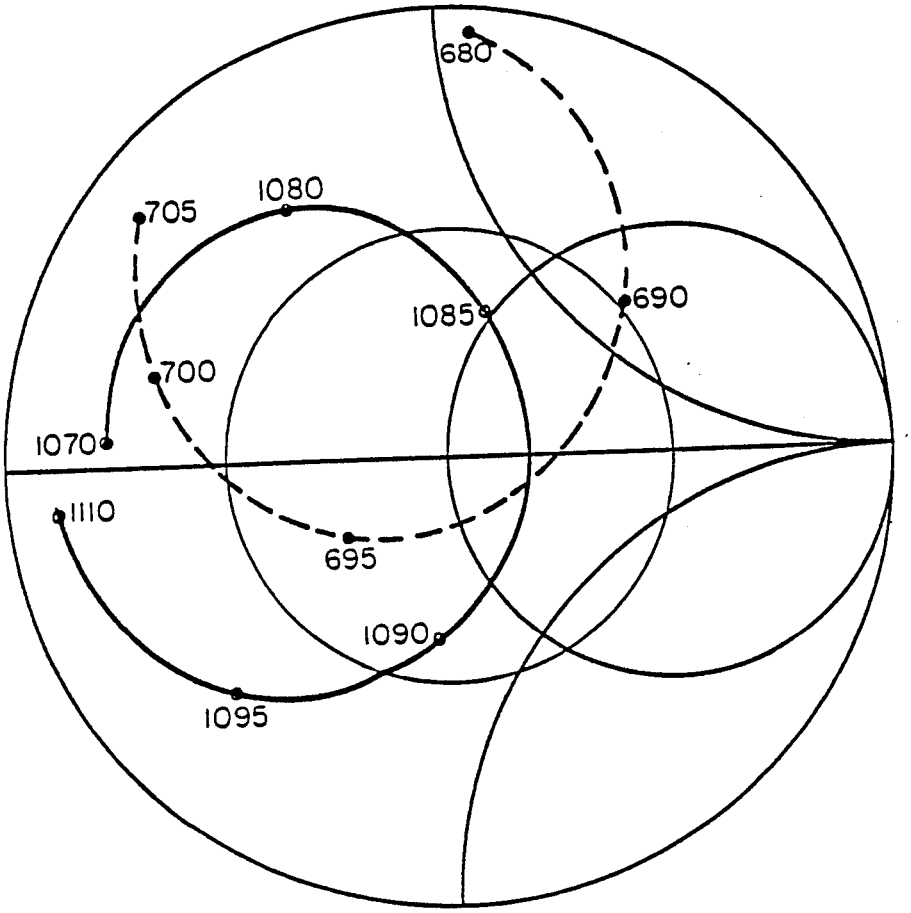
FIG. 5*a* illustrates impedance loci for a rectangular microstrip antenna with 3 slots and 4 pins.
Figure 5B:
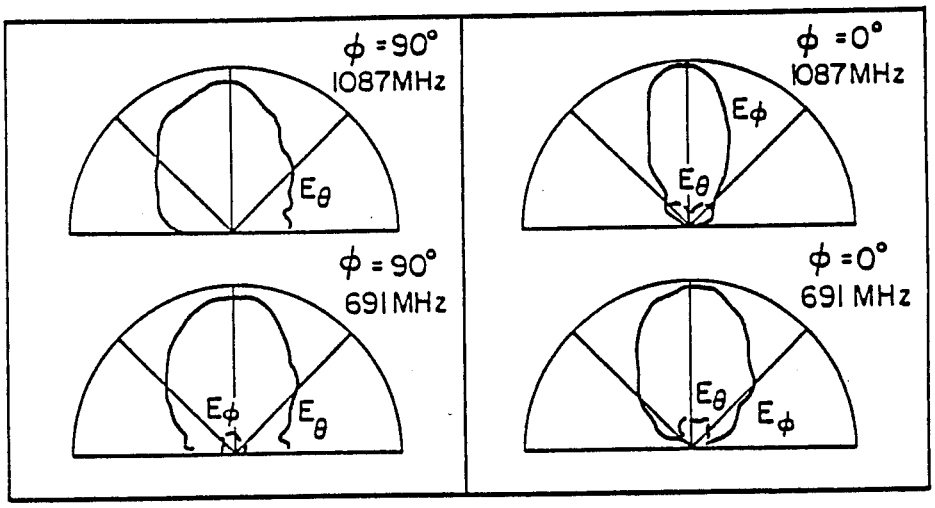
FIG. 5*b* illustrates measured radiation patterns for the rectangular microstrip antenna of FIG. 5*a;*
Figure 6A:
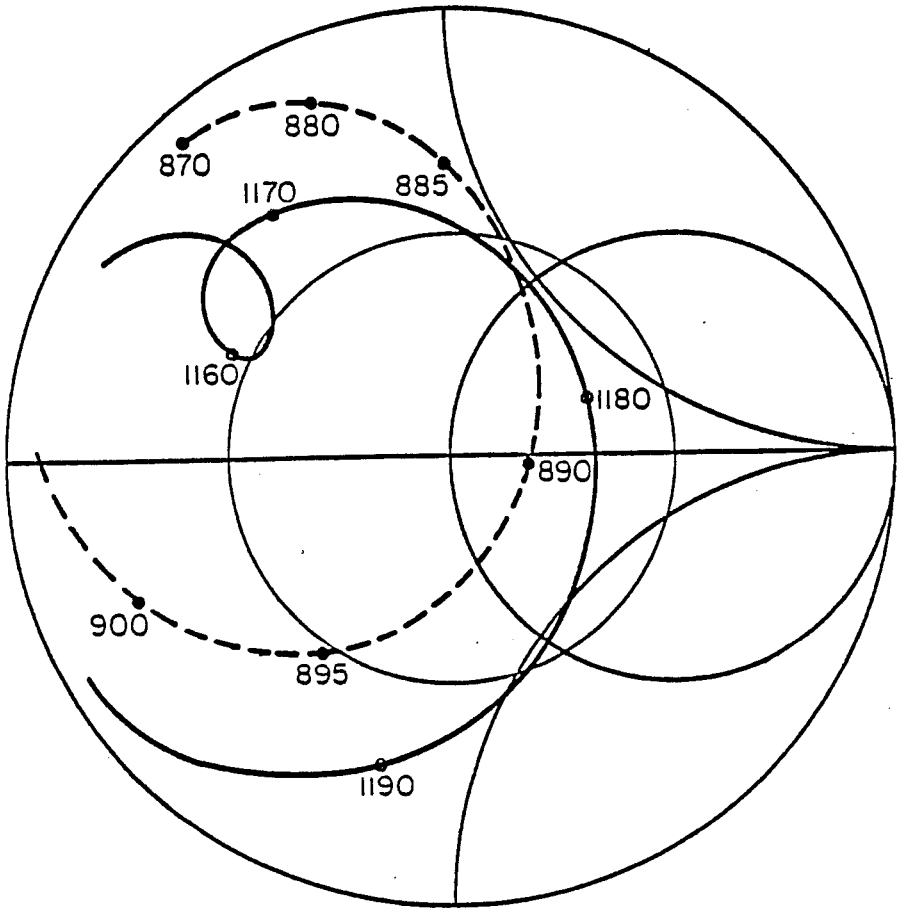
FIG. 6*a* illustrates measured impedance loci for a rectangular microstrip antenna with 3 slots and 10 pins.
Figure 6B:
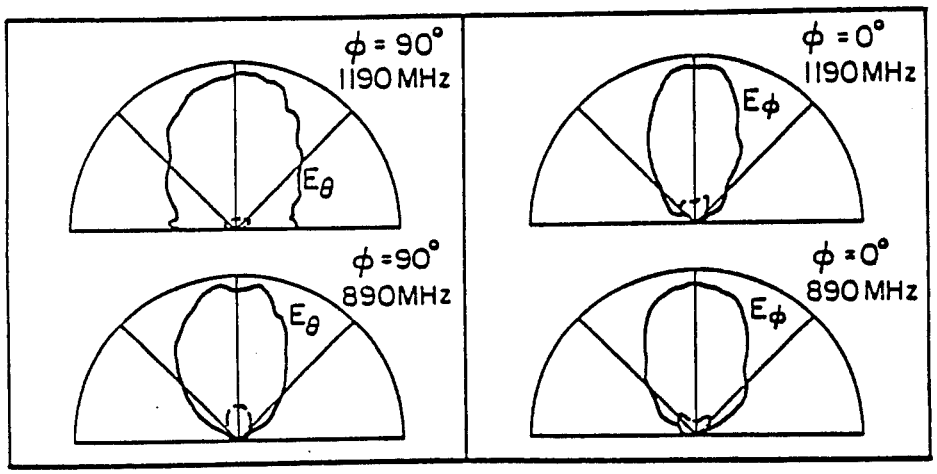

To further reduce the ratio of the operating frequencies of the high and low band, $F_H/F_L$, in addition to the slots, shorting pins can be inserted along the nodal lines of the (0,3) module electric field as illustrated in FIG. 4. Due to limited space here, only a few typical measured impedance loci and radiation patterns for both bands are shown in FIGS. 3, 5 and 6. From FIGS. 3, 5 and 6, it is seen that while the "resonant" frequencies are changed for both bands with pins and slots, in general, the radiation patterns for both bands remain primarily the same. It may also be noted that the input impedance can vary widely with the feed position and one is therefore free to choose the feed position for a desired impedance without undue concern about its effect on the pattern. The measured gains of these microstrip antennas as compared with those of a $\lambda/2$-tuned dipoles, $0.2\lambda$ over a ground plane, are approximately $-0.5$ to $-1$ db for the low band and $-1.5 \sim 2$ db for the high band.

Table 1 summarizes the values of $F_H/F_L$ for six cases. From these results, it is seen that in general the slots can lower $F_H$ and shorting pins raise $F_L$, resulting in a variation of $F_H/F_L$ from 3.02 to 1.31. In fact, this ratio can be reduced even further by adding more pins and slots. However, the effectiveness of adding more pins and slots will eventually diminish. Instead, we find that the ratio $F_H/F_L$ can be reduced to about 1.07 by using a C-shaped slot (or a wrapped around microstrip line). This will be addressed in the discussion about FIG. 7.

TABLE I

THE OPERATING FREQUENCIES FOR BOTH $F_L$ AND $F_H$

| CASE | $F_L$ (MHz) | $F_H$ (MHz) | $F_H/F_L$ |
|---|---|---|---|
| A. One slot $l_1$ = 1.0 cm at (9.7, 7.3) | 628 | 1900 | 3.02 |
| B. One slot $l_1$ = 3.0 cm at (9.7, 7.3) | 596 | 1700 | 2.85 |
| C. Three slots $l_1$ = 7.0 cm $l_2 = l_3$ = 3.0 cm at (9.7, 2.4), (9.7, 7.3) and (9.7, 12.2) | 555 | 1420 | 2.55 |
| D. Three slots $l_1 = l_2 = l_3$ = 7.0 cm at the same location as in case C. | 553 | 1310 | 2.36 |
| E. Same as case D but with four pins as shown in FIG. 4. | 698 | 1087 | 1.56 |
| F. Same as case E with six additional pins at (3.7, 2.4), (9.7, 2.4), (15.7, 2.4), (3.7, 12.2), (9.7, 12.2) and (15.7, 12.2). | 890 | 1181 | 1.31 |

The embodiment of the invention described above is a single rectangular microstrip antenna element that can be designed to perform for dual frequency bands corresponding approximately to the (0,1) and (0,3) modes. The frequencies of both bands can be tuned over a wide range, with their ratio from 3 to less than 1.3, by adding shorting pins and slots in the patch. A method for analyzing these antennas has been developed and treats the antenna as a multi-port cavity. The validity of this theory is verified by comparing the computed impedance loci and radiation patterns with the measured for a few simple cases.

As a design guide, in general, the effect of a slot on the high-band frequency is stronger if it is placed where the high-order modal magnetic field is stronger, and the effect of the short pin on the low-band frequency is stronger if it is placed where the low-order modal electric field is stronger.

Figure 7:
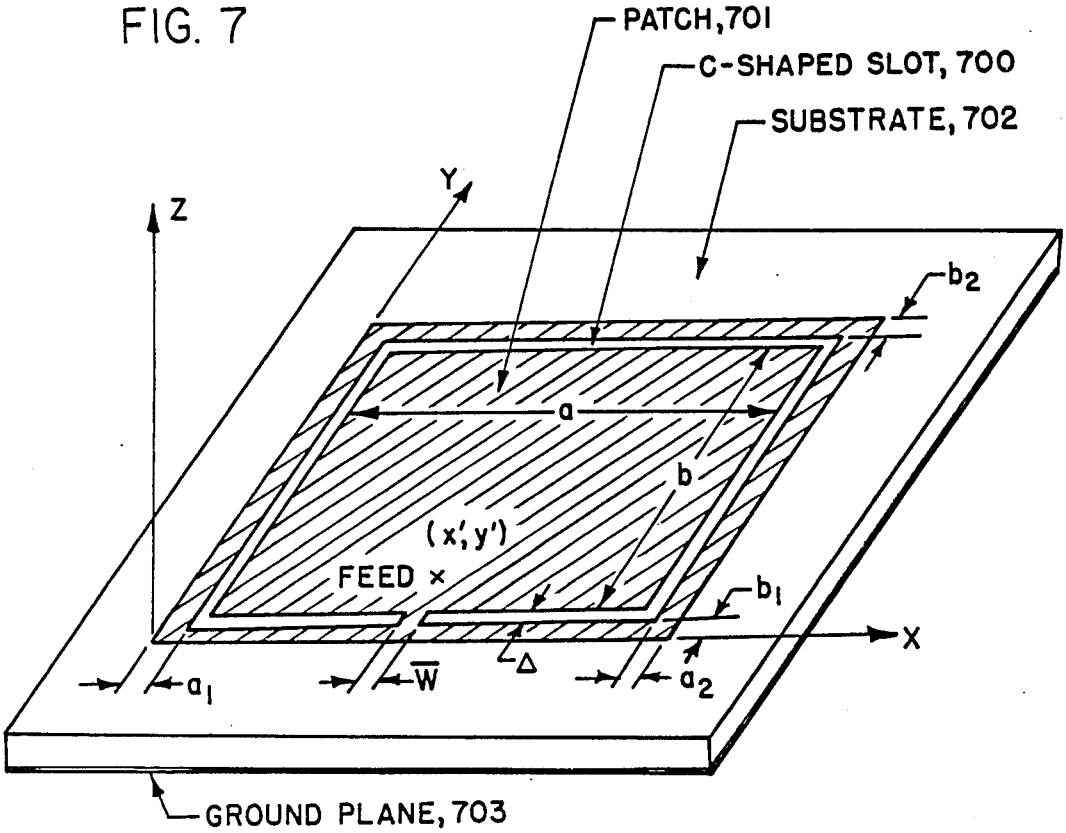
* and FIG. 7 is a schematic of another embodiment of the present invention.

FIG. 7 is a schematic depicting another embodiment of the present invention, which entails a microstrip antenna with a c-shaped slot. In this embodiment, the c-shaped slot 700 is cut in the patch 701 which is surrounded by a substrate 702 which coats a conductive ground plane 703. The ground plane 703 is fed by a conventional means such as the coaxial feed or a u line depicted in FIG. 1.

The theory behind the invention, as embodied in FIG. 7 is based on two speculations. First, for thin microstrip antennas a strong field should be built up under the patch. Second, the structure might be considered as a parallel connection between a conventional rectangular microstrip patch antenna (PA) and a wrap-around around microstrip transmission line (TL). From the first observation, one perhaps could neglect the difficult problem of evaluating the coupling effect between PA and TL and obtain a useful first-order solution. To gain some credence to this approach, the impedance characteristics of the PA and the TL in the absence as well as in the presence of each other was measured.

As described above, one could compute the input impedance of the PA. The susceptance of the wrap-around TL is obtained using the following approximate formula:

$$B_{TL}=2Y_o \tan (k_o\sqrt{\epsilon_e}l_e) \tag{20}$$

where $\epsilon_e$=effective permittivity for the line $$\approx \frac{1}{2}\left[(\epsilon_r+1)+(\epsilon_r-1)\left(1+\frac{10t}{d}\right)^{-\frac{1}{2}}\right],$$

$$Y_o \approx \frac{2\sqrt{\epsilon_r}}{377}\left[\frac{d}{2t}+0.441+0.082\frac{\epsilon_r-1}{\epsilon_r^2}+\left(\frac{\epsilon_r+1}{2\pi\epsilon_r}\right)\left[1.451+\ln\left(\frac{d}{2t}+0.94\right)\right]\right],$$

$\epsilon_r$=relative permittivity of the substrate,
d=width of the TL,
t=thickness of the substrate,
$k_o$=free-space wave number,
$_e$=effective TL length≃average of one half of the rectangular ring length.

Because of the symmetry in this case, the rectangular ring TL can be considered as two open lines, each being one half the ring, in parallel, which lead to Equation (20). In this computation, the discontinuities at the bends and T-junction are neglected. The two adjacent resonant frequencies of the TL are indicated by $F_1$ and $F_2$ and that of the PA by $F_o$. With the two connected in parallel, the resonant frequencies should occur at $F_L$≃1.17–1.19 GHz and $F_H$≃1.336–1.344 GHz. These predicted values, agree very well with the experimentally measured values of 1.174 and 1.335 GHz, respectively.

Much improved values, for example, for matching to a 50 ohm line for both bands, can be obtained by moving the feed inside the patch. A more rigorous approach for this case can be made by using the multiple port theory described in part above.

For this method, the PA resonant frequency $F_o$ must be between the two adjacent resonant frequencies $F_1$ and $F_2$ of the TL. The separation between $F_1$ and $F_2$ is inversely proportional to $l_e$ of the TL:

$$F_1-F_2=v/4l_e$$

where $v=3\times10^8/\sqrt{\epsilon_r}$ if $l_e$ is in meters. Thus to reduce the ratio ($F_H/F_L$), in general $l_e$ shall be increased. This is shown in Tables 2 and 3 for a=99 mm, b=77 mm, $w=a_1=a_2=b_1=b_2=6$ mm. First it is seen that the ratio for this example can be reduced to as small as 1.05. Second, the ratio does not necessarily decrease as $l_e$ increases as in Table 3. This could be caused by the unknown coupling effect since the gap Δ between the PA and the TL is much smaller in this case. Furthermore, the input susceptance of the PA is not that of a simple resonant circuit or TL.

There are many possible ways to tune or to change the ratio of $F_H$ and $F_L$. For example, if a=99 mm, b=77 mm, $a_1=a_2=28$ mm, w=5 mm, and Δ=2 mm, the ratio $F_H/F_L$ can be varied with $b_1$ and $b_2$ as shown in Table 4. Shorting pins, a short tab, or a varactor if placed on the TL, for example, at $x=a_1+\Delta+a/2$, $y=b+2(\Delta+b_1)$, can obviously be used for tuning $F_H$ and $F_L$.

TABLE 2

VARIATION OF OPERATING FREQUENCIES $F_L$ AND $F_H$ WITH TL LENGTH $l_e$

| | | | |
|---|---|---|---|
| Δ (mm) | 81 | 86 | 88.5 |
| $l_e$ (mm) | 350 | 360 | 365 |
| $F_H$ (MHz) | 1280 | 1244 | 1235 |
| $F_L$ (MHz) | 1190 | 1174 | 1180 |
| $F_H/F_L$ | 1.075 | 1.06 | 1.05 |

TABLE 3

VARIATION OF OPERATING FREQUENCIES $F_L$ AND $F_H$ WITH TL LENGTH $l_e$

| | | | | | | |
|---|---|---|---|---|---|---|
| Δ (mm) | 38.5 | 36 | 31 | 23.5 | 16 | 9 |
| $l_e$ (mm) | 265 | 260 | 250 | 235 | 220 | 206 |
| $F_H$ (MHz) | 1199 | 1204 | 1216 | 1236 | 1225 | 1312 |
| $F_L$ (MHz) | 955 | 980 | 996 | 1071 | 1103 | 1164 |
| $F_HF_L$ | 1.255 | 1.258 | 1.22 | 1.154 | 1.137 | 1.126 |

TABLE 4

VARIATION OF OPERATING FREQUENCIES $F_L$ AND $F_H$ WITH TO WIDTH $b_1$ AND $b_2$

| | | | |
|---|---|---|---|
| $b_1$ (mm) | 23 | 15.5 | 8 |
| $b_2$ (mm) | 23 | 15.5 | 8 |
| $F_H$ (MHz) | 1228 | 1210 | 1215 |
| $F_L$ (MHz) | 976 | 990 | 1055 |
| $F_H/F_L$ | 1.258 | 1.22 | 1.15 |

Several embodiments of a tunable single element dual-frequency microstrip antenna have been described which is only slightly larger than a conventional single frequency band patch antenna. Additionally, a theory is presented which appears capable of predicting the two frequency bands quite accurately and also provides much physical insight into the operation mechanism. From this theory it is obvious that this technique can be applied to patch antennas of other geometries as well.

While the invention has been described in its presently preferred embodiment it is understood that the words which have been used are words of description rather than words of limitation and that changes within the purview of the appended claims may be made without departing from the scope and spirit of the invention in its broader aspects.

What is claimed is:

1. A dual frequency microstrip antenna comprising:

a dielectric substrate which has a top surface and a bottom surface;

a conductive layer attached to the bottom surface of the dielectric substrate thereby forming a ground plane;

a feeding means attached to the ground plane and conducting first and second radio frequency signals into the conductive layer; said first radio frequency signal having a first frequency $F_H$, said second radio frequency signal having a second frequency $F_L$, said second frequency being lower than said first frequency;

a conductive patch attached to the top surface of the dielectric substrate, said conductive patch having at least one of a plurality of slots which are in the conductive patch and reduce the first frequency of the first radio frequency signal, said plurality of slots thereby affecting a ratio of $F_H/F_L$; and shorting means attached between said conductive patch and said conductive layer, said shorting means providing an electrical short circuit with conducting pins at locations on the conductive patch to the conductive layer and raising the second frequency of the second radio frequency signal thereby causing a variation in the ratio of $F_H/F_L$, said locations including positions in said conductive patch where high order modal electric fields are weakest so that their presence will not disturb high frequency operation, thus providing an independent means to control $F_L$.

2. A dual frequency microstrip antenna, as defined in claim 1, wherein said shorting means comprise:

at least one of a plurality of shorting pins which are removably inserted between said conductive layer and said conductive patch at said locations, said shorting pins have a negligible effect on (0,3) operating frequencies when inserted along nodal lines of an (0,3) mode electric field between said conductive layer and said conductive patch, but said shorting pins raising (0,1) operating frequencies thereby serving to cause said variation in the ratio $F_H/F_L$ while leaving radiation patterns relatively unchanged.

3. A dual frequency microstrip antenna, as defined in claim 2, wherein said plurality of slots in said conductive patch are placed at positions in the conductive patch where modal magnetic fields are strongest, said plurality of slots thereby reducing the (0,3) mode high frequency of the first radio frequency signal by a maximum amount, but having only a negligible effect on the (0,1) operating frequencies, thus providing an approximately independent means to control $F_H$.

4. A dual frequency microstrip antenna, as defined in claim 3, wherein said ratio $F_H/F_L$ ranges from about 3.02 to 1 or lower, if more slots are introduced.

5. A dual frequency microstrip antenna, as defined in claim 4, wherein said first frequency of said first radio frequency signal ranges from about 1,181 to 1,900 MHz, and said second frequency of said second radio frequency signal ranges from about 628 to 890 MHz.

6. A dual frequency microstrip antenna, as defined in claim 5, wherein said conductive patch has a length of 19.4 cm, and a width of 14.6 cm, said dielectric substrate has a relative permittivity of about 2.62, and said feed means comprises a 50 ohm coaxial cable.

7. A dual frequency microstrip antenna, as defined in claim 6 wherein said conductive patch has a single slot of about 1.0 cm in length located at its center.

8. A dual frequency microstrip antenna, as defined in claim 6, wherein said conductive patch has a single slot of about 3.0 cm in length located at its center.

9. A dual frequency microstrip antenna, as defined in claim 6 wherein said conductive patch has first, second and third slots, said first slot being 7.0 cm in length and located at said conductive patch's center, said second and third slots being about 3.0 cm in length and positioned parallel with and on either side of said first slot in said conductive patch with a space of about 10 cm between said second and third slots.

10. A dual frequency microstrip antenna, as defined in claim 9 wherein said shorting means comprises four shorting pins, two of said four shorting pins aligned with and on either end of said second slot, and another two of said four shorting pins aligned with and on either side of said third slot, each of said four pins being positioned so that they form a square having sides about 10 cm in length on said conductive patch.

11. A dual frequency microstrip antenna comprising:

a dielectric substrate which has a top surface and a bottom surface;

a conductive layer attached to the bottom surface of the dielectric substrate thereby forming a ground plane;

a feeding means attached to the ground plane and conducting first and second radio frequency signals into the conductive layer; said first radio frequency signal having a first frequency $F_H$, said second radio frequency signal having a second frequency $F_L$, said second frequency being lower than said first frequency; and a conductive patch attached to the top surface of the dielectric substrate, said conductive patch having a c-shaped slot which forms a ring in the conductive patch which has an effective open-circuited transmission line length of about one half of the rectangular ring's length, said c-shaped slot producing a separation between said first frequency and said second frequency said separation decreasing as transmission line length of the c-shaped slot increases.

12. A dual frequency microstrip antenna, as defined in claim 11, wherein the separation between said first frequency and said second frequency is given by:

$$F_H - F_L = V/4l_e$$

in Hertz where:

$l_e$ = the effective C-shaped transmission line length in meters;

$$V = \frac{3 \times 10^8}{\sqrt{\epsilon r}};$$

and r = the electric substrates relative permittivity.

* * * * *